US005697310A

United States Patent [19]

Shirakura et al.

[11] Patent Number: 5,697,310

[45] Date of Patent: Dec. 16, 1997

[54] LOOPER SWITCHING MECHANISM IN OVERLOCK SEWING MACHINE

[75] Inventors: Yoshirou Shirakura; Shinji Kojima, both of Utsunomiya, Japan

[73] Assignee: The Singer Company N.V., Curaco, Netherlands Antilles

[21] Appl. No.: 693,811

[22] Filed: Aug. 1, 1996

[30] Foreign Application Priority Data

Aug. 9, 1995 [JP] Japan ..... 7-222743

[51] Int. Cl.[6] ..... D05B 61/00

[52] U.S. Cl. ..... 112/168; 112/162

[58] Field of Search ..... 112/168, 162, 112/199, 200, 475.26, 166, 177

[56] References Cited

U.S. PATENT DOCUMENTS 3,783,810 1/1974 Marforio ..... 112/200 X 4,237,804 12/1980 Hirayama ..... 112/162 X 4,690,080 9/1987 Mikuni et al. ..... 112/168 X 4,942,834 7/1990 Kitai ..... 112/199

*Primary Examiner*—Ismael Izaguirre

*Attorney, Agent, or Firm*—McCormick, Paulding & Huber

[57] ABSTRACT

In a looper switching mechanism for an overlock sewing machine, a needle having a needle thread and movable vertically, is provided. A right looper having a thread hole at a tip end through which a right looper thread is inserted, includes a mounting hole into which a shaft portion of a spreader member body is attached. A hook portion having a tip end engageable with the thread hole is coupled to and extends from the spreader member body thereby forming the a spreader.

4 Claims, 7 Drawing Sheets

LOOPER SWITCHING MECHANISM IN OVERLOCK SEWING MACHINE

BACKGROUND OF THE INVENTION

1. Field of the Invention

The present invention relates to a looper switching mechanism in an overlock sewing machine.

2. Prior Art

An overlock sewing machine comprises a needle having a needle thread and movable vertically, an upper right looper having a right looper thread and operable in a direction crossing with a moving direction of a product to be sewn (workpiece), and a lower left looper having a left looper thread and swingable right and left, wherein the needle, the right looper and the left looper are cooperative with one another to carry out an overlock stitch.

In a conventional overlock sewing machine for carrying out one-needle-three-thread overlock stitch, when a one-needle-three-thread overlock stitch is switched to a one-needle-two-thread overlock stitch based on the change of a thickness of a workpiece, it is known that this switching operation is carried out by one touch control, for example, as disclosed in JP-B 60-20031 and JP-Y 63-1984. Meanwhile, since the one-needle-three-thread overlock stitch is carried out by tightening the workpiece with combined three threads, puckers are liable to generate on a thin cloth. Accordingly, the one-needle-two-thread overlock stitch is needed, thereby requiring the aforementioned switching operation.

In these overlock sewing machines, a base end of a spreader member is swingably attached to a right looper retainer wherein an operation position where the spreader member is precisely retained by the tip end of the right looper and an inoperation position where the spreader member is released from the retention are switched to each other when the spreader member is turned. The switching operation can be carried out with attaching the spreader member, i.e., without detaching the spreader member.

However, since the conventional looper switching mechanism of the overlock sewing machine is structured in such a manner that the spreader member is always provided on the right looper not to detached from the right looper, when the spreader is not formed by the spreader member and the right looper is used to perform its inherent function in a state where the right looper thread is inserted into a thread hole bored therein, there is needed a mechanism for holding the spreader member with assurance in the inoperative position where the spreader member does not obstruct the one-needle-three-thread overlock stitch. For this reason, there occurs a problem that the such mechanism becomes complex in a structure and always receives vibration so that it is easily troubled, and it costs high.

The present invention has been made to solve such problems and comprises as follows.

A looper switching mechanism in an overlock sewing machine according to a first aspect of the invention comprises a needle having a needle thread and movable vertically, and a right looper having a thread hole at a tip end thereof though which a right looper thread is inserted and operable in a direction crossing with a moving direction of a workpiece, characterized in that the right looper has a hole to which a shaft portion of a spreader member is engaged to be inserted, the shaft portion is inserted into the hole from a front of the hole, and the hook portion of the spreader member is retained by the recess from the back surface thereof, thereby forming a spreader.

A looper switching mechanism according to a second aspect of the invention is characterized in that the spreader member comprises a spreader member body made of synthetic resin and the hook portion formed of a spring wire rod and projecting from the spreader member body, and the spreader member body comprises a knob portion, a shaft portion extending backward from the knob portion and being engaged in the hole of the right looper and a restriction portion extending sideward from the knob portion and being retained by an upper surface of the right looper.

A looper switching mechanism according to a third aspect of the invention is characterized in that the recess of the right looper is a thread hole, and wherein a retaining portion provided at a tip end of the hook portion is positioned at a central axis of the thread hole of the right looper in a state where the shaft portion of the spreader member body is engaged in the hole of the right looper and the restriction portion of the spreader member body is retained by the upper surface 1*a* of the right looper.

A looper switching mechanism according to a fourth aspect of the invention is characterized in that the shaft portion of the spreader member is engaged in receiving parts provided in a front cover of the overlock sewing machine, and the spreader member can be accommodated in the overlock sewing machine by inserting the shaft portion into the receiving parts when the spreader member is not used.

According to the first aspect of the invention, when the one-needle-three-thread overlock stitch is switched to the one-needle-two-thread overlock stitch, the spreader member 18 is attached to the right looper 1. That is, the shaft portion 19*a* of the spreader member 18 is inserted into the hole 11 of the right looper 1 from the front thereof. At that time, the hook portion 20 is allowed to pass over the right looper 1 at its upper position. When the spreader member body 19 is fully inserted into the hole 11, the spreader member 18 is turned about the shaft portion 19*a* is so as to position the hook portion 20 at the back of the right looper 1.

Successively, the tip end of the hook portion 20 is inserted into the recess 12 of the right looper 1. In a state where the tip end of the hook portion 20 is inserted into the recess 12 of the right looper 1, a middle portion of the hook portion 20, which extends from the spreader member 18 and is gradually inclined downward, is cooperative with the tip end of the right looper 1, thereby forming the spreader. It is possible to easily detach the spreader member 18 from the right looper 1 by taking the procedure contrary to the aforementioned procedure.

According to the second aspect of the invention, when the spreader member 18 is attached to the right looper 1, the shaft portion 19*a* of the spreader member 18 is inserted into the hole 11 of the right looper 1 from the front thereof, then the spreader member 18 is turned about the shaft portion 19*a* in one direction while holding the knob portion 19*c* after the shaft portion 19*a* is fully inserted into the hole 11, successively the lower surface of the restriction portion 19*b* is brought into contact with and retained by the upper surface 1*a* of the right looper 1. At this time, since the hook portion 20 is formed of a spring wire rod, the hook portion 20 is held by the finger tip, if need be, so as to bend and deform the hook portion 20 backward so that the hook portion 20 is positioned at the back of the right looper 1, then it is retained by the recess 12 of the right looper 1. As a result, the hook portion 20, which extends from the spreader member body 19 and is gradually inclined downward, is cooperative with the tip end of the right looper 1, while the lower surface of the restriction portion 19*b* is retained by the upper surface la of the right looper 1, thereby forming the spreader. Meanwhile, if the back surface of the knob portion 19*c* of the spreader member body 19 is retained by the peripheral edge portion of the hole 11, and the hook portion 20 formed by the spring wire rod is elastically retained by the back surface of the right looper 1, the spreader member 18 is preferably restrained from being rattled.

According to the third aspect of the invention, the retaining portion 20*c* of the hook portion 20 is positioned substantially on the central axis of the recess 12 of the right looper 1 in a state where the lower surface of the restriction portion 19*b* is brought into contact with and retained by the upper surface 1*a* of the right looper 1. Thereafter, when the hook portion 20 is moved forward while the lower surface of the restriction portion 19*b* is retained by the upper surface 1*a* of the right looper 1, the retaining portion 20*c* positioned at the tip end of the hook portion 20 is automatically inserted into the thread hole 12 serving as the recess 12 of the right looper 1. Accordingly, the spreader is formed by the middle portion of the hook portion 20.

According to the fourth aspect of the invention, since the spreader member 18 is accommodated in the front cover 23 of the overlock sewing machine when it is not used, it can be immediately detached from the receiving parts 23*a* and is used when it is intended to be used.

PREFERRED EMBODIMENT OF THE INVENTION

First Embodiment (FIGS. 1 through 11):

A looper switching mechanism in the overlock sewing machine according to a first embodiment of the present invention will be now described with reference to FIGS. 1 through 11.

Figure 1:
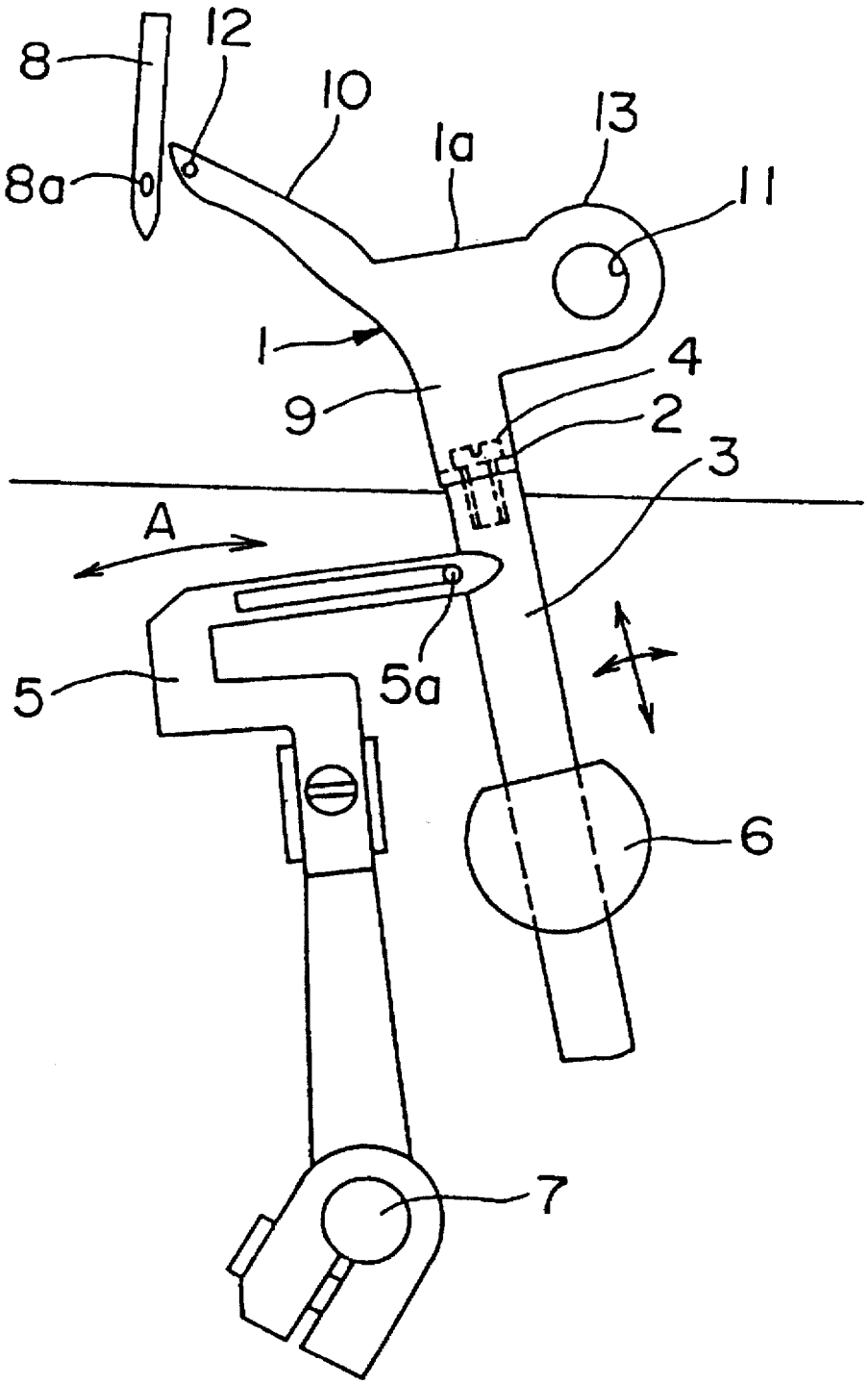
FIG. 1 is a front view showing a main portion of an overlock sewing machine according to a first embodiment of the present invention.
Figure 3:
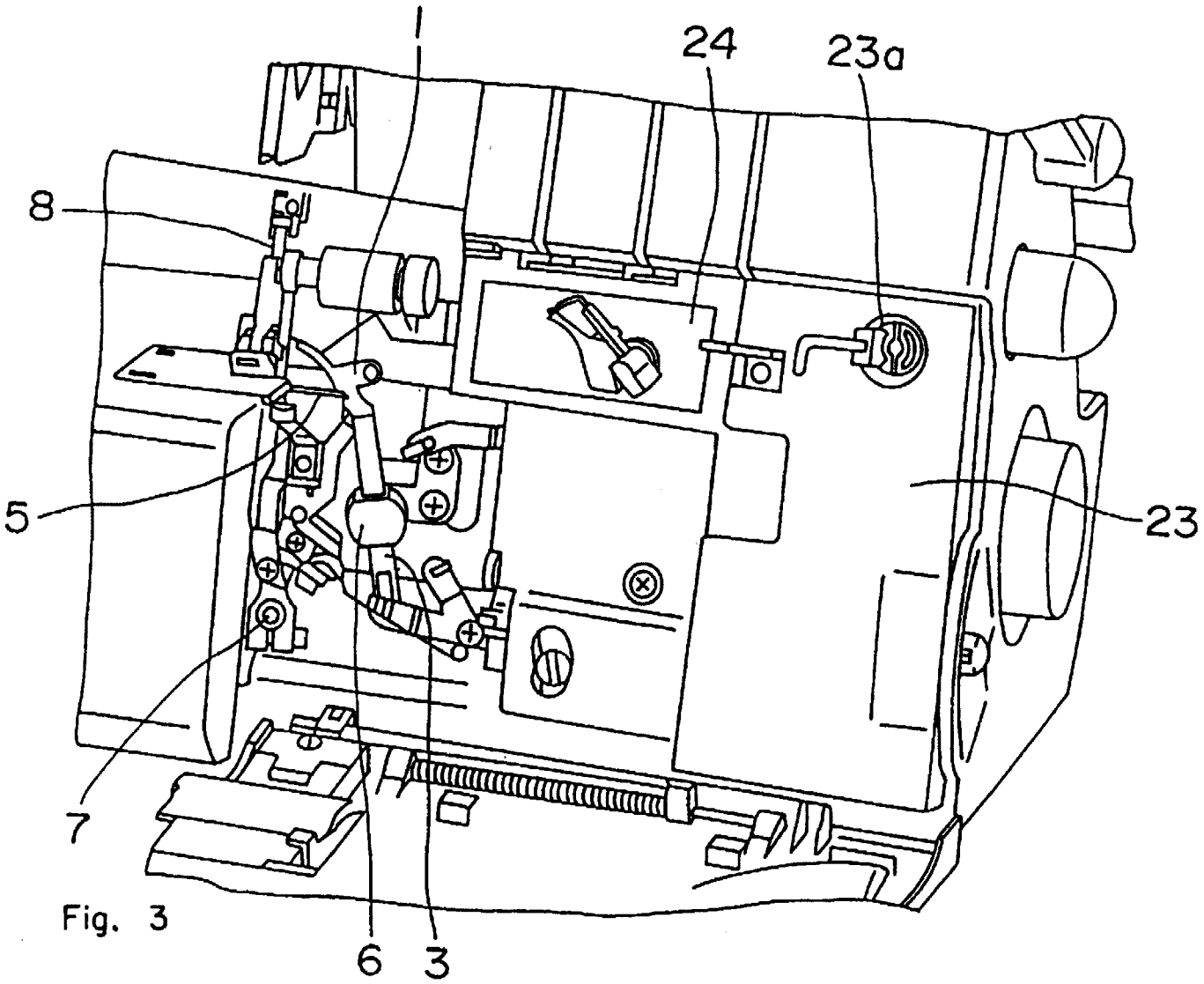
FIG. 3 is a front view showing a main portion of the overlock sewing machine of FIG. 1.

In FIG. 1, denoted by 1 is a right looper 1. The right looper 1 is fixed to an upper end of a right looper retainer 3 by fixing screw 4 inserted into a fixing seat 2 thereof. The right looper retainer 3 slidably penetrates a looper retainer guide 6 which is provided on a front surface of a frame of the overlock sewing machine so as to be freely turned as shown in FIG. 3, thereby giving a predetermined repetitive motion, i.e., operation in a direction crossing with a moving direction of the workpiece to the right looper 1.

A left looper 5 has a thread hole 5*a* through which a left looper thread is inserted, and it is swingable about a left looper shaft 7 serving as a fulcrum extending forward and backward relative to the frame of the overlock sewing machine so that it performs a reciprocal swinging motion in a direction as denoted by an arrow A.

The needle 8 moves vertically while a needle thread is inserted into a thread hole 8*a* at the lower end thereof, and it lowers as the left looper 5 swings leftward in FIG. 1.

The right looper 1 has a supporting portion 9 extending upward from the fixing seat 2, a blade portion 10 extending from the supporting portion 9 toward the needle 8 and having a thread hole 12 at the tip end thereof, and a bracket portion 13 extending rightward from the supporting portion 9, wherein a hole 11 is bored in the bracket portion 13, i.e., in a right end of the right looper 1, and a contact surface is formed on a upper surface 1*a* of the right looper 1 extending between the blade portion 10 and the bracket portion 13 in which a restriction portion 19*b* of a spreader member 18, described later, contacts the contact surface of the upper surface 1*a*.

Figure 2:
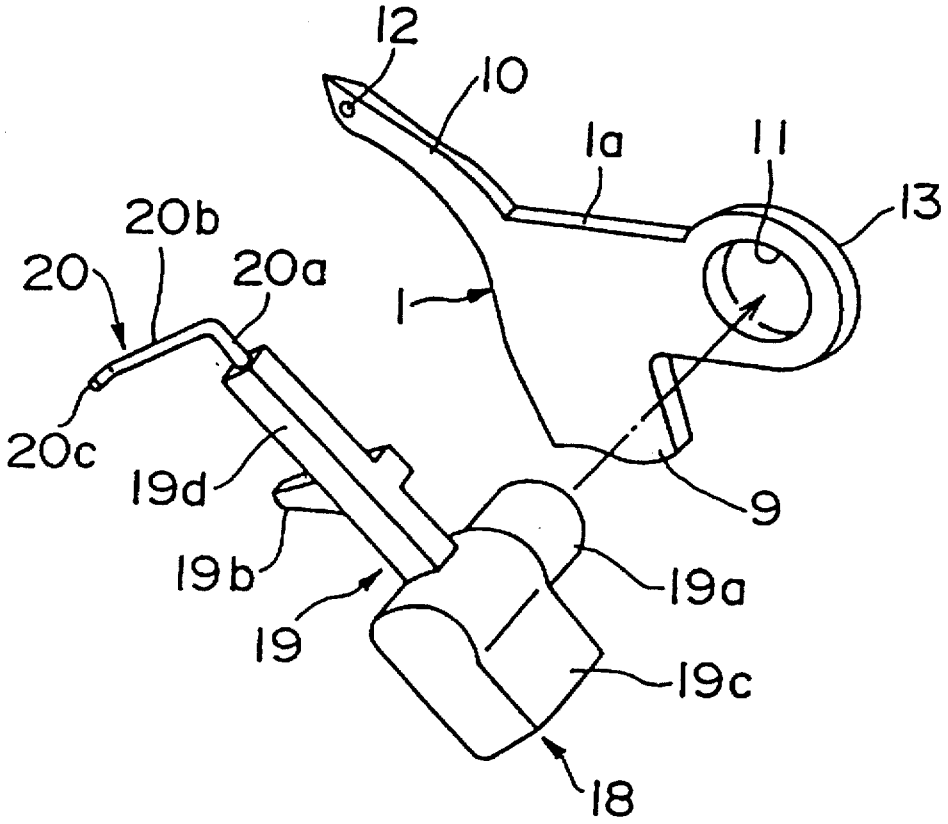
FIG. 2 is a perspective view showing a main portion of a looper switching mechanism of the overlock sewing machine of FIG. 1.
Figure 4:
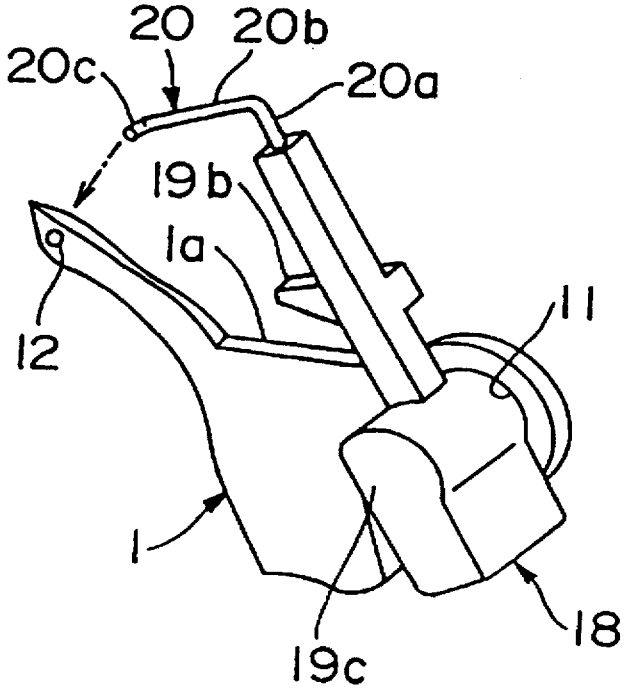
FIG. 4 is a view showing an operation of the looper switching mechanism of FIG. 2, namely, an operation between the right looper 1 and the spreader member 18.

Denoted by 18 in FIG. 2 is the spreader member forming a spreader. The spreader member 18 comprises a spreader member body 19 made of synthetic resin and a hook portion 20. The spreader member body 19 comprises a shaft portion 19*a* and a restriction portion 19*b* which can be brought into contact with and retained by the upper surface 1*a* of the right looper 1 and a knob portion 19*c*. The shaft portion 19*a* protrudes cylindrically from the back surface of the knob portion 19*c* and is engageable into the hole 11 of the right looper 1 so as to be inserted. The shaft portion 19*a* is cylindrical so as to permit the spreader member 18 to be turned about the shaft portion 19*a* , and the hole 11 in which the shaft portion 19*a* is engaged is formed circular. However the shaft portion 19*a* and the hole 11 may be formed of any shape other than those set forth above, namely, if they have a shape in a manner that the restriction portion 19*b* is allowed to be turned in a given angular interval until it contacts the upper surface 1*a* of the right looper 1 in a state where the shaft portion 19*a* is engaged in the hole 11, and a retaining portion 20*c* of the hook portion 20, described later, can be inserted into the thread hole 12 of the right looper 1.

The restriction portion 19*b* protrudes from the front surface of the middle portion of a supporting potion 19*d*, which protrudes from the knob portion 19*c* in a direction perpendicular to a central axis of the shaft portion 19*a* , and it extends leftward, then the lower surface thereof is brought into contact with and retained by the upper surface 1*a* of the right looper 1, so as to restrict the turning of the spreader member 18 in a counterclockwise direction. The knob portion 19c is used for turning the spreader member 18 in a state where the shaft portion 19a is inserted into the hole 11 of the right looper 1, and it is formed on the base ends of the shaft portion 19a and the supporting portion 19d and has a shape and a size so as to be held easily.

The hook portion 20 is formed of one spring wire rod (wire rod formed of spring steel), and comprises a fixing portion 20a, an extension portion 20b, a retaining portion 20c which are respectively sequentially turned at right angles. The hook portion 20 is fixed to the supporting portion 19d while the fixing portion 20a is pressed into the tip end of the supporting portion 19d, and the retaining portion 20c has a central axis which is substantially in parallel with the central axis of the shaft portion 19a in its free state, and protrudes in a direction opposite to the shaft portion 19a.

The retaining portion 20c is positioned at the central axis of the thread hole 12 in a state where the shaft portion 19a is inserted into the hole 11 of the right looper 1, and the lower surface of the restriction portion 19b is brought into contact with and retained by the upper surface 1a of the right looper 1.

Figure 11:
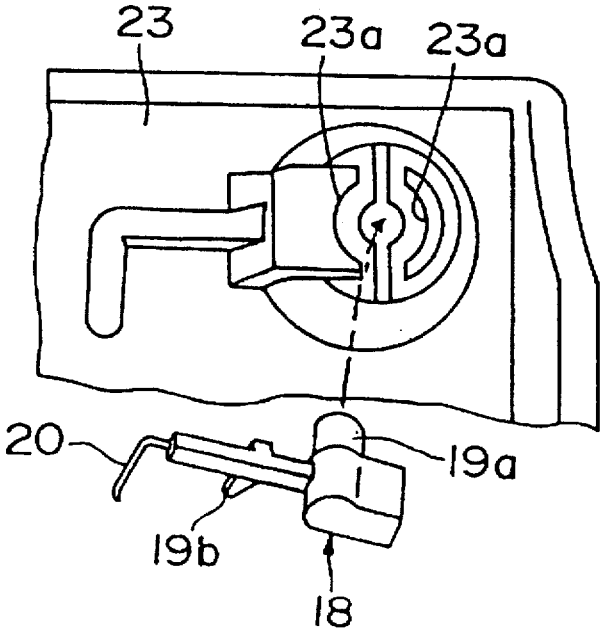
FIG. 11 is a front view showing the spreader member receiving portion of the overlock sewing machine.

The spreader member 18 is accommodated in receiving parts 23a of the front cover 23 forming the front surface of the overlock sewing machine when it is not used as shown in FIGS. 3 and 11. Concretely, a pair of confronted receiving parts 23a each having an arc-shaped surface protrude from the front cover 23 so as to clamp the shaft portion 19a of the spreader member 18 therebetween, wherein the spreader member 18 can be accommodated in the receiving parts 23a by elastically inserting the shaft portion 19a into the receiving parts 23a when the spreader member 18 is not used. A sticker 24 is pasted on the front cover 23 adjacent to the right looper 1. The sticker 24 explains how to switch between the one-needle-three-thread overlock stitch and the one-needle-two-thread overlock stitch, i.e., how to attach the spreader member 18 to the right looper 1.

The operation of the looper switching mechanism will be now described hereinafter.

Figure 7:
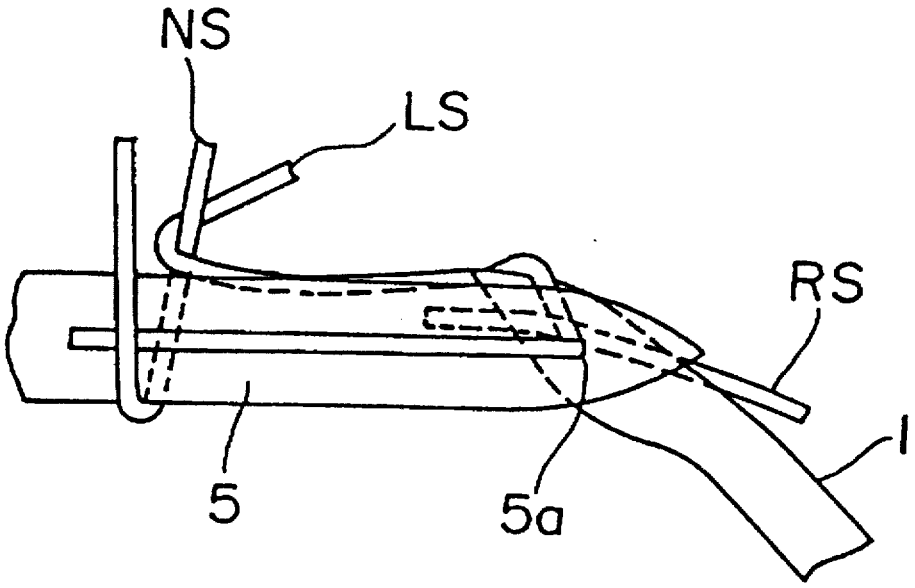
FIG. 7 is a view showing an operation of the looper switching mechanism of FIG. 1, namely, an operation between the right looper 1 and a left looper 5.
Figure 8:
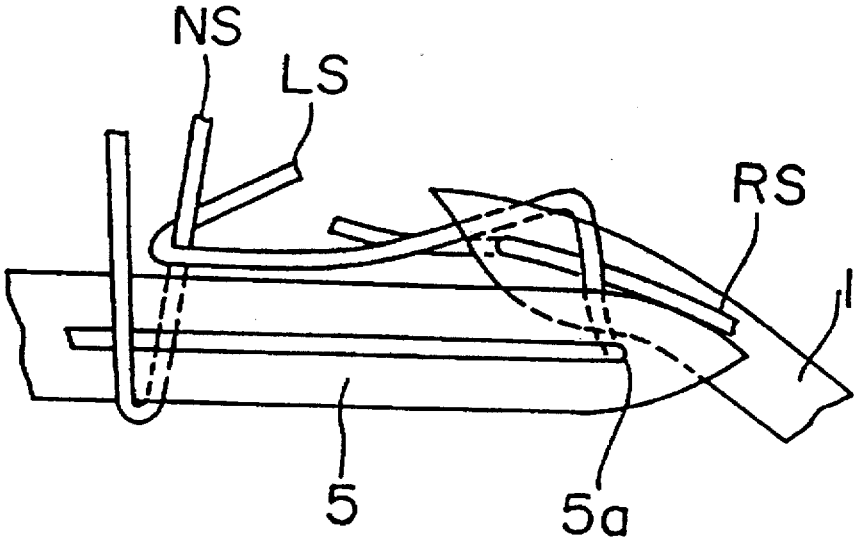
FIG. 8 is a view showing another operation of the looper switching mechanism of FIG. 1, namely, the operation between the right looper 1 and the left looper 5.

Described first with reference to FIGS. 7 and 8 is a case to carry out the one-needle-three-thread overlock stitch while the needle 8, the right looper 1 and the left looper 5 are cooperative with one another. At this time, since the spreader member 18 is not used, it remains accommodated into the receiving parts 23a of the front cover 23. In this state, the one-needle-three-thread overlock stitch is carried out by a needle thread NS, a right looper thread RS inserted into the thread hole 12 bored in the right looper 1, and a left looper thread LS inserted into the thread hole 5a bored in the left looper 5.

When the one-needle-three-thread overlock stitch is switched to the one-needle-two-thread overlock stitch, the spreader member 18 is attached to the right looper 1 as shown in FIG. 2, and FIGS. 4 through 6. First, the spreader member 18 is pulled out from the receiving parts 23a of the front cover 23, then the shaft portion 19a is inserted into the hole 11 of the right looper 1 from the front thereof as shown in FIG. 2. At this time, the hook portion 20 allows the retaining portion 20c to pass over the right looper 1 as an upper position thereof. If the shaft portion 19a is fully inserted into the hole 11, the spreader member 18 is turned counterclockwise about the shaft portion 19a while the knob portion 19c is held, then the lower surface of the restriction portion 19b is brought into contact with and held by the right looper 1. At this time, the extension portion 20b is bent backward to be deformed while it is held by the finger tip as denoted by the broken lines in FIG. 6 so that the retaining portion 20c is positioned at the back portion of the blade portion 10 of the right looper 1. In a state where the lower surface of the restriction portion 19b is brought into contact with and retained by the upper surface 1a of the right looper 1, the retaining portion 20c provided at the tip end of the extension portion 20b is positioned substantially at the central axis of the thread hole 12 of the right looper 1.

Figure 5:
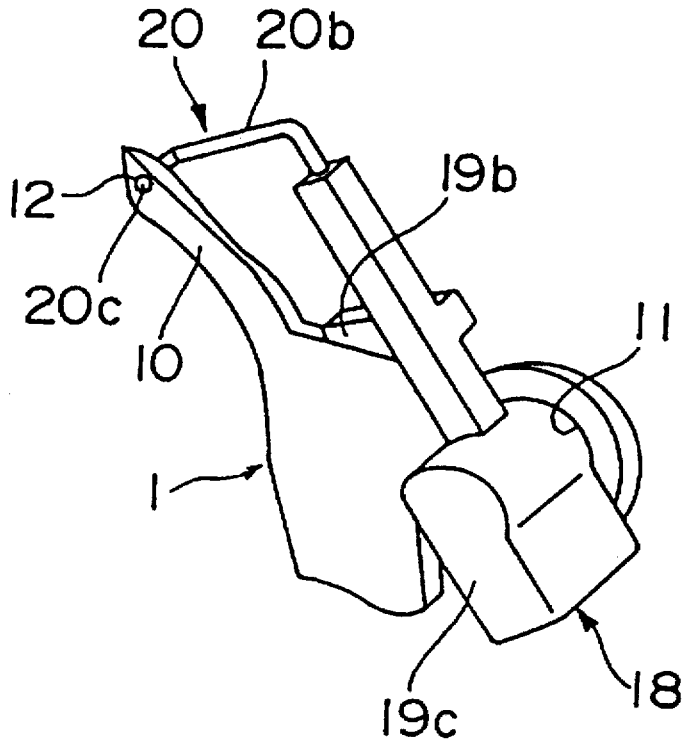
FIG. 5 is a view showing another operation of the looper switching mechanism of FIG. 2, namely, the operation between the right looper 1 and the spreader member 18.
Figure 6:
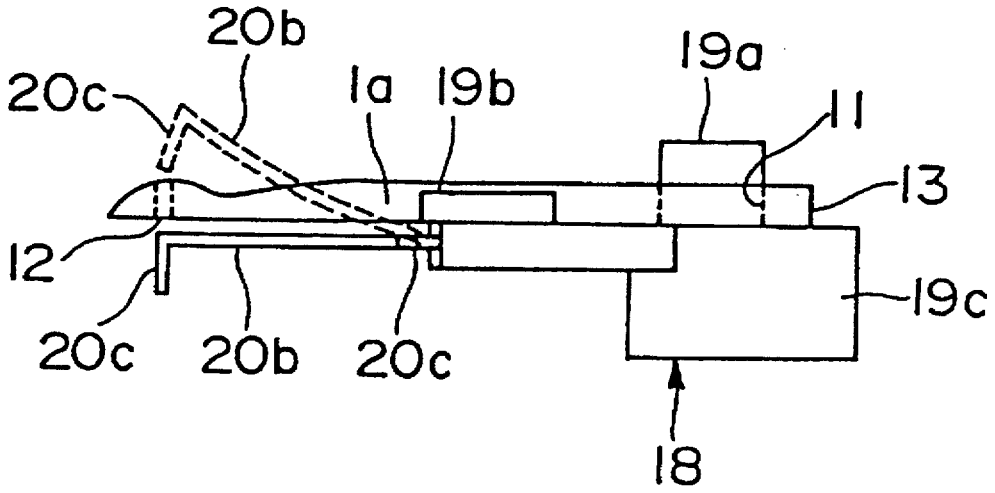
FIG. 6 is a view showing a still another operation of the looper switching mechanism of FIG. 2, namely, the operation between the right looper 1 and the spreader member 18.

Thereafter, the extension portion 20b held by the finger tip is released. Accordingly, the extension portion 20b is elastically restored to its original state while the lower surface of the restriction portion 19b is retained by the upper surface 1a of the right looper 1 so that the tip end of the retaining portion 20c is automatically inserted into the thread hole 12 of the right looper 1 as shown in FIG. 5. In a state where the retaining portion 20c is inserted into the thread hole 12 of the right looper 1, the extension portion 20b which extends from the spreader member body 19 and is gradually inclined downward is cooperative with the tip end of the blade portion 10 of the right looper 1, thereby forming the spreader. This state is maintained when the back surface of the knob portion 19c of the spreader member body 19 is retained by the front surface of the bracket portion 13, i.e., the peripheral edge of the hole 11, and the extension portion 20b is retained by the back surface of the blade portion 10, so that the spreader member 18 is hardly rattled.

Figure 9:
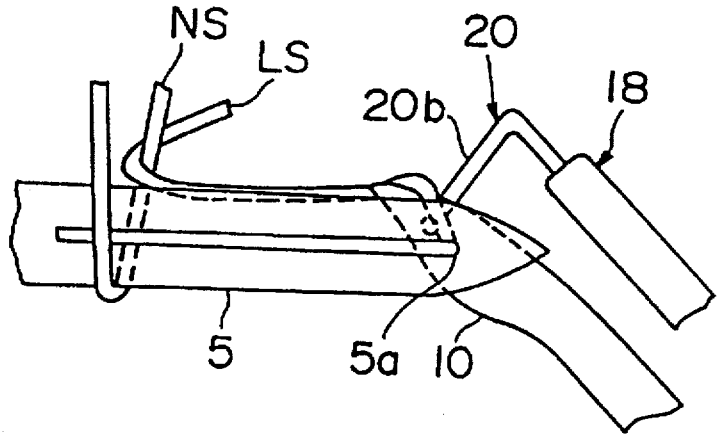
FIG. 9 is a view showing an operation of the looper switching mechanism, namely, an operation between the left looper 5 and the spreader member 18.
Figure 10:
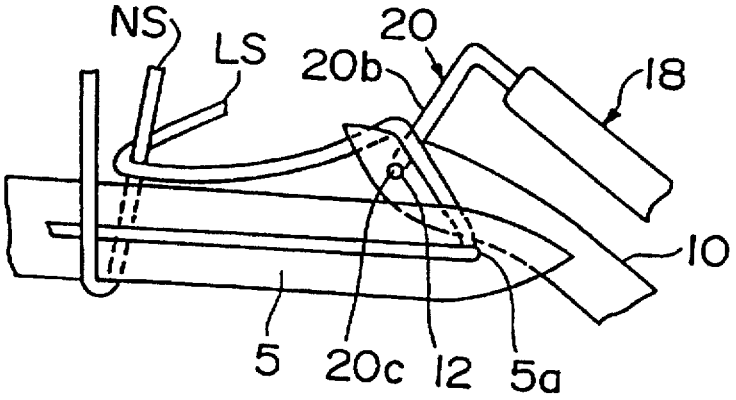
FIG. 10 is a view showing another operation of the looper switching mechanism, namely, the operation between the left looper 5 and the spreader member 18.

In such a manner, the one-needle-two-thread overlock stitch is carried out in a state where the spreader member forms spreader with the right looper 1. That is, as shown in FIGS. 9 and 10, the one-needle-two-thread overlock stitch is carried out by two threads namely, the needle thread NS inserted into the thread hole 8a of the needle 8 and the left looper thread LS inserted into thread hole 5a of the left looper 5 in a state where the retaining portion 20c of the hook portion 20 is inserted into the thread hole 12 of the right looper 1. The spreader member 18 can be easily detached from the receiving parts 23a by taking the procedure contrary to the aforementioned procedure.

Since the spreader member 18 is accommodated in the front cover 23 when it is not used, it can be easily pulled out from the front cover 23 and is immediately used when it is intended to be used. The sticker 24 is pasted on the front cover 23 adjacent to the right looper 1 and it explains how to fix the spreader member 18 to the right looper 1. Accordingly, the spreader member 18 can be easily used with reference to the sticker 24.

Second Embodiment (FIGS. 12 and 13):

A looper switching mechanism according to a second embodiment of the present invention will be now described with reference FIGS. 12 and 13.

Components which are the same as those in the first embodiment are denoted by the same numerals and the explanation thereof is omitted.

The hook portion 20 of the second embodiment comprises one spring wire rod (wire rod made of spring steel) like the first embodiment, but has an extension portion 20d extending backward from the fixing portion 20a between the fixing portion 20a and the extension portion 20b in the first embodiment. The extension portion 20d is formed to have a length in a manner that the tip end of the retaining portion 20c is positioned at the back of the right looper 1 in a state where the back surface of the spreader member body 19 is brought into contact with the front surface of the right looper 1 as shown in FIG. 12. A plurality of concave portions 19f are formed in the knob portion 19*c* of the spreader member 18 in the peripheral direction and they are opened at the back surface, wherein a spring member 22 having a base end fixed to a bottom surface of each concave portion 19*f* is disposed in each concave portion 19*f*. The tip end of each spring member 22 protrudes from each concave portion 19*f* by a given length in its free state.

According to the second embodiment, the spreader member 18 is fixed to the right looper 1 as follows.

Figure 12:
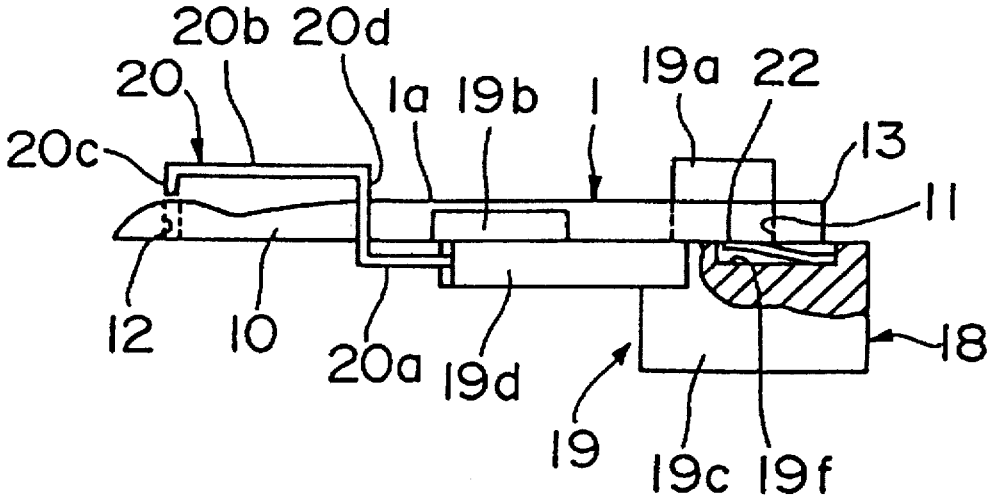
FIG. 12 is a plan view of a looper switching mechanism according to second embodiment of the present invention wherein a part of the mechanism is cut.
Figure 13:
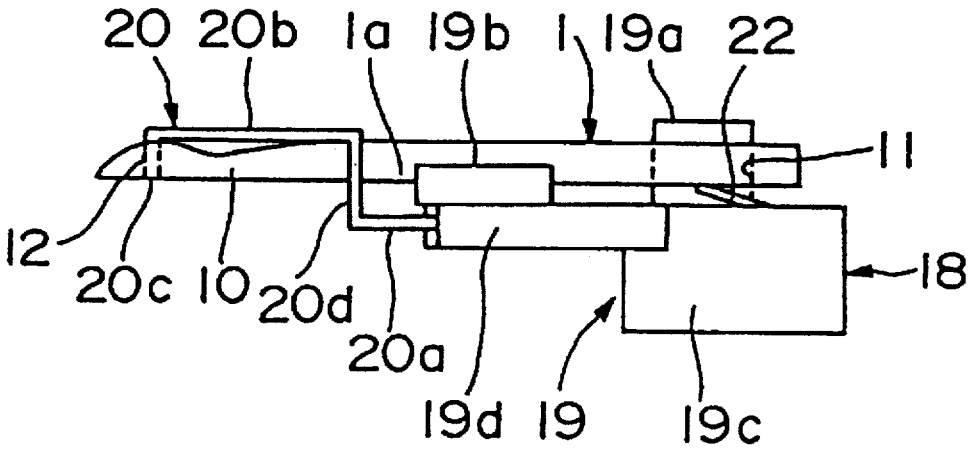
FIG. 13 is a view showing an operation of the looper switching mechanism of FIG. 12, namely, an operation between the right looper 1 and the spreader member 18.

First, as shown in FIG. 12, the shaft portion 19*a* of the spreader member 18 is inserted into the hole 11 of the right looper 1 from the front thereof. At this time, each spring member 22 is brought into contact with the front surface of the right looper 1 so as to be elastically deformed. The hook portion 20 allows the extension portion 20*b* and the retaining portion 20*c* to pass over the right looper 1 as an upper position thereof. When the shaft portion 19*a* is fully inserted into the hole 11 and the back surface of the spreader member body 19 is brought into contact with the front surface of the right looper 1, the spreader member 18 is turned counterclockwise about the shaft portion 19*a* while the spreader member 18 remains inserted into the hole 11, then the lower surface of the restriction portion 19*b* is brought into contact with and retained by the upper surface 1*a* of the right looper 1. At this time, the extension portion 20*b* and the retaining portion 20*c* are respectively positioned at the back of the right looper 1 owing to the presence of the extension portion 20*d*. Accordingly, the extension portion 20*b* is not necessary to be held by the finger tip to be directed backward so as to be bent and deformed. The retaining portion 20*c* provided at the tip end of the extension portion 20*b* is positioned at the central axis of the thread hole 12 of the right looper 1 in a state where the lower surface of the restriction portion 19*b* is brought into contact with and retained by the upper surface 1*a* of the right looper 1.

Next, the spreader member 18 is released from the insertion into the hole 11. Accordingly, the spring member 22 is elastically restored to its original state, and hence the spreader member 18 is pressed back in the forward direction so that the tip end of the retaining portion 20 is automatically inserted into the thread hole 12 of the right looper 1. When the spreader member 18 is pressed back in the forward direction, the blade portion 10 of the right looper 1 is elastically clamped between the extension portion 20*b* and the spring member 22 so that the spreader member 18 is hardly rattled. In a state where the retaining portion 20*c* is inserted into the thread hole 12 of the right looper 1, the extension portion 20*b* which is inclined downward toward the retaining portion 20*c*, is cooperative with the blade portion 10 of the right looper 1 like the extension portion 20*b* in FIG. 9, thereby forming the spreader. Meanwhile, the shaft portion 19*a* has a sufficient length in the central axis direction thereof, and it is appropriately inserted into the hole 11 from the front thereof in a state where the extension portion 20*b* is brought into contact with the back surface of the blade portion 10 of the right looper 1 so that it is prevented from being come off.

The spreader member can be easily detached by taking the procedure contrary to the aforementioned procedure. As far as the formation of the spreader, it is possible to obtain substantially the same function as that of the first embodiment. In addition to such function, the spreader can be easily formed since the extension portion 20*b* is not needed to be held by the finger tip to be directed backward so as to be bent and deformed.

Meanwhile, although the retaining portion 20*c* of the spreader member 18 is inserted into the thread hole of the right looper 1, an exclusive concave portion may be formed at the tip end back surface of the blade portion 10 of the right looper 1, and the retaining portion 20*c* of the spreader member 18 is retained by the concave portion, thereby forming the spreader.

As is evident from the above explanation, the right looper 1 may be integrally and largely formed to have a hole in which the shaft portion of the spreader member is engaged, and the spreader member is detached from the right looper 1 when is not used, and is prevented from being vibrated always, so that the structure thereof is made simple and is difficult to be troubled, and is excellent in durability, and can be manufactured with low cost.

According to the second aspect of the invention, since the spreader member comprises the hook portion formed of the spring wire rod and the spreader member body made of synthetic resin which are integrated with each other, so that the structure is simple and it is difficult to be troubled and is excellent in durability, and manufactured with low cost. In addition to such effect, the one-needle-three-thread overlock stitch and the one-needle-two-thread overlock stitch can be easily switched by one touch control since the spreader member can be attached and detached to the right looper, whereby the switching from the one-needle-three-thread overlock stitch to the one-needle-two-thread overlock stitch can be easily made by merely engaging the shaft portion of the spreader member to the hole of the right looper and the tip end of the hook portion of the spreader member is inserted into the recess of the right looper.

According to the third aspect of the invention, the retaining portion formed at the tip end of the hook portion is automatically inserted into the recess serving as the thread hole of the right looper, thereby hardly causing an error in the formation of the spreader.

According to the fourth aspect of the invention, the spreader member is inserted into the receiving parts of the front cover of the overlock sewing machine and is accommodated therein when the spreader member is not used, it does not obstruct the one-needle-three-thread overlock stitch and is prevented from being stolen. Further, it can be easily used when it is intended to be used.

What is claimed is:

1. A looper switching mechanism in an overlock sewing machine comprising:

a needle having a needle thread and being movable vertically;

a right looper having a thread hole at a tip end thereof through which a right looper thread is inserted, and a mounting hole spaced apart from the thread hole, the right looper being operable in a direction crossing with a moving direction of a workpiece;

a spreader member body having a knob portion, a supporting portion extending from the knob portion, and a shaft portion protruding from the knob portion engageable with the mounting hole in the right looper;

a hook portion having a tip engageable with the thread hole, the hook portion being coupled to, and extending from the supporting portion, thereby forming a spreader.

2. A looper switching mechanism according to claim 1, wherein:

the spreader member body is made of synthetic resin and the hook portion is formed from a spring wire rod; and wherein the spreader member body comprises a restriction portion extending sideward from the knob portion and being retained by an upper surface of the right looper.

3. A looper switching mechanism according to claim 2, wherein a retaining portion is provided at the tip end of the hook portion and is positioned at a central axis of the thread hole of the right looper when the shaft portion of the spreader member body is engaged in the mounting hole, and wherein the restriction portion of the spreader member body is retained by an upper surface of the right looper.

4. A looper switching mechanism according to claim 1, wherein the overlock sewing machine includes a cover adapted to receive the shaft portion of the spreader member for retaining the spreader member when not in use.

* * * * *